US006994596B2

(12) United States Patent
Katsuma et al.

(10) Patent No.: US 6,994,596 B2
(45) Date of Patent: Feb. 7, 2006

(54) TERMINAL FITTING, A CONNECTOR PROVIDED THEREWITH AND METHOD OF FORMING A TERMINAL FITTING

(75) Inventors: Takatoshi Katsuma, Yokkaichi (JP); Hikaru Ito, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/858,648

(22) Filed: Jun. 2, 2004

(65) Prior Publication Data

US 2004/0224569 A1 Nov. 11, 2004

(30) Foreign Application Priority Data

Jun. 5, 2003 (JP) ..... 2003-160868

(51) Int. Cl.
*H01R 13/432* (2006.01)

(52) U.S. Cl. ..... 439/746

(58) Field of Classification Search ..... 439/746, 439/852, 851, 748, 872, 850, 456, 459, 744–749, 439/871, 275

See application file for complete search history.

(56) References Cited

U.S. PATENT DOCUMENTS 4,047,791 A * 9/1977 Carter ..... 439/828
5,624,273 A * 4/1997 Myer ..... 439/399
5,716,242 A * 2/1998 Myer ..... 439/748
5,911,603 A * 6/1999 Mansutti ..... 439/748
5,997,363 A * 12/1999 Joly ..... 439/748
6,152,763 A * 11/2000 Sai ..... 439/752
6,165,026 A * 12/2000 Sugie et al. ..... 439/748
6,186,837 B1 * 2/2001 Abe ..... 439/748
6,325,680 B1 * 12/2001 Suzuki ..... 439/852
6,368,165 B2 * 4/2002 Kubo ..... 439/752
6,679,736 B2 * 1/2004 Saka ..... 439/748
6,790,105 B2 * 9/2004 Fukatsu et al. ..... 439/884

* cited by examiner

*Primary Examiner*—Gary Paumen
*Assistant Examiner*—Phuongchi Nguyen
(74) *Attorney, Agent, or Firm*—Gerald E. Hespos; Anthony J. Casella

(57) ABSTRACT

A terminal fitting (10) is formed to be mountable into a resin housing (30). A metal lock (11) is formed by cutting and bending in a bottom plate (14) of the terminal fitting (10) and is resiliently engageable with an engaging portion (34) in the housing (30) to lock the terminal fitting (10). This metal lock (11) has a base (11A) in the form of a flat plate. An extended portion (11B) is at the leading end of the base (11A) and bulges out in thickness or width direction, thereby increasing an area of engagement with the engaging portion (34) when the terminal fitting (10) is pulled in withdrawing direction. Accordingly, the terminal fitting (10) has a terminal holding force enhanced by the presence of the extended portion (11B).

8 Claims, 10 Drawing Sheets

TERMINAL FITTING, A CONNECTOR PROVIDED THEREWITH AND METHOD OF FORMING A TERMINAL FITTING

BACKGROUND OF THE INVENTION

1. Field of the Invention

The invention relates to a terminal fitting with a lock, to a connector with terminal fitting that has a lock and to a method of forming a terminal fitting.

2. Description of the Related Art

U.S. Pat. No. 6,679,736 discloses a female terminal fitting formed by bending an electrically conductive metal plate. The terminal fitting has a box-shaped fitting portion and a wire connecting portion continuous with the rear end of the fitting portion. A wire is connected with the wire connecting portion by crimping. A resilient contact piece is folded back at the front edge of a bottom plate of the fitting portion. Thus, a tab of a mating male terminal fitting can be inserted into the fitting portion to connect the terminal fittings. A metal lock is formed by making a cut in the bottom plate of the fitting portion and bending the cut portion obliquely out. The terminal fitting can be inserted into a cavity of a resin housing. As a result, the metal lock resiliently engages the inner wall of the cavity to lock the terminal fitting in the cavity.

The wire may be pulled back while the terminal fitting is in the cavity. As a result, the leading end of the metal lock bites in and scrapes the facing inner wall of the cavity. The leading end of the metal lock is a flat plate having the same width as the base end. As a result, the metal lock engages the inner wall of the cavity to display a suitable terminal holding force. However, there is a demand to lock the terminal fitting with a stronger terminal holding force.

The present invention was developed in view of the above problem and an object thereof is to enhance a terminal holding force.

SUMMARY OF THE INVENTION

The invention relates to a terminal fitting for mounting in a housing. The terminal fitting has a metal lock that is resiliently engageable with an engaging portion in the housing to lock the terminal fitting in the housing. The metal lock comprises a base in the form of a substantially flat plate. An extended portion is near the leading end of the base and bulges out in thickness direction and/or in widthwise direction to increase an area of engagement with the engaging portion when the terminal fitting is pulled in withdrawing direction.

The metal lock of the terminal fitting engages the engaging portion in the housing to hold the terminal fitting so as not to come out. The extended portion at or near the leading end of the base of the metal lock bites in the wall surface of the engaging portion and is fixed strongly if the terminal fitting is pulled in withdrawing direction. Thus, the extended portion enables the terminal fitting to have a holding force larger than the prior art.

The lock preferably is formed by cutting and bending.

The extended portion preferably is formed by embossing a portion of the base. Additionally, the extended portion preferably is formed at the same time as the lock by cutting and/or stamping.

At least one lateral lock protecting portion is formed in the terminal fitting near the leading end of the lock. The protecting portions are formed by making cuts extending over an edge from a lateral plate where the lock is formed, to adjacent side walls and bending plate pieces formed inside the cuts to extend out substantially to the opposite sides.

The invention also relates to a connector having at least one cavity into which the above-described terminal fitting is insertable.

The invention further relates to a method of forming a terminal fitting. The method comprises providing a conductive plate; forming a lock with a base in the form of a substantially flat plate, and providing an extended portion at or near the leading end of the base and bulging out in the thickness direction and/or in widthwise direction.

The lock preferably is formed by cutting and bending.

The extended portion preferably is formed by embossing a portion of the base. Additionally, the extended portion preferably is formed at the same time as the lock by cutting and/or stamping.

The method may further comprise a step of forming at least one lateral lock protecting portions in the vicinity of the leading end of the lock.

These and other features of the invention will become more apparent upon reading the following detailed description of preferred embodiments and accompanying drawings. Even though embodiments are described separately, single features may be combined to additional embodiments.

DETAILED DESCRIPTION OF THE PREFERRED EMBODIMENTS

Figure 1:
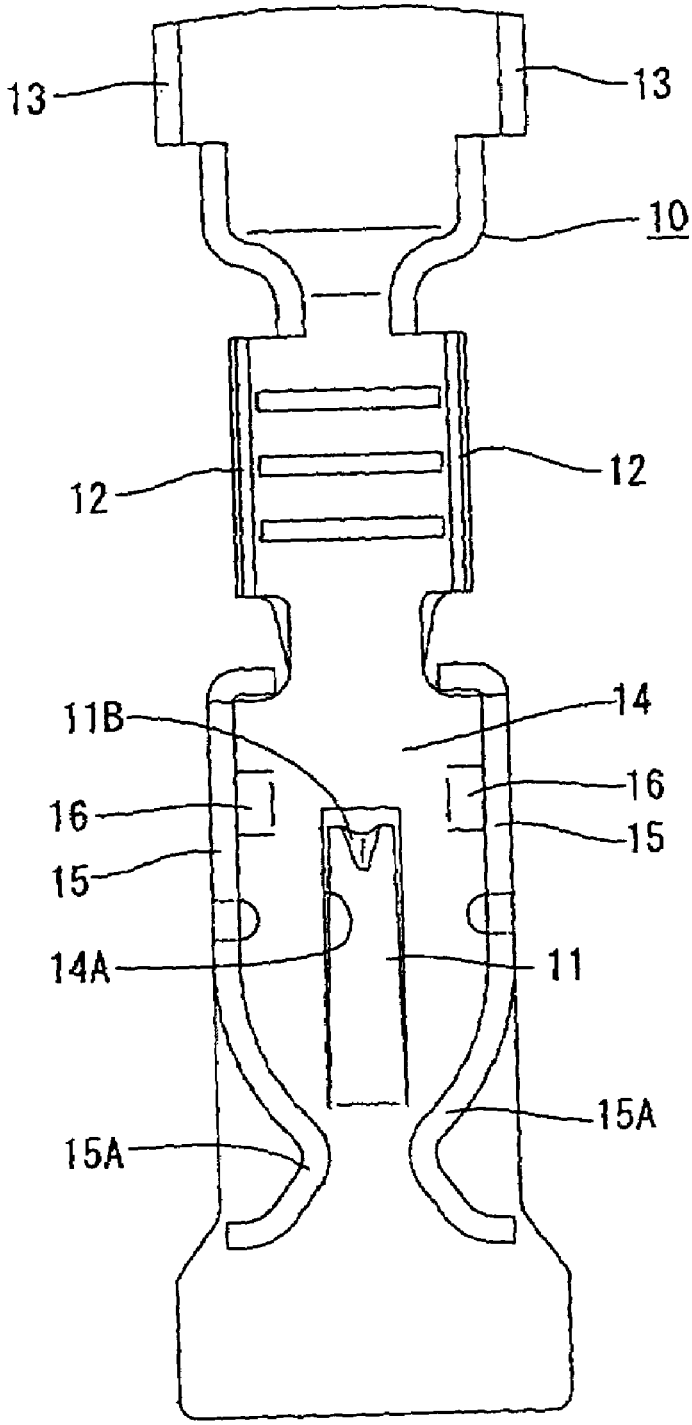
FIG. 1 is a plan view of a terminal fitting according to a first embodiment of the invention.
Figure 2:
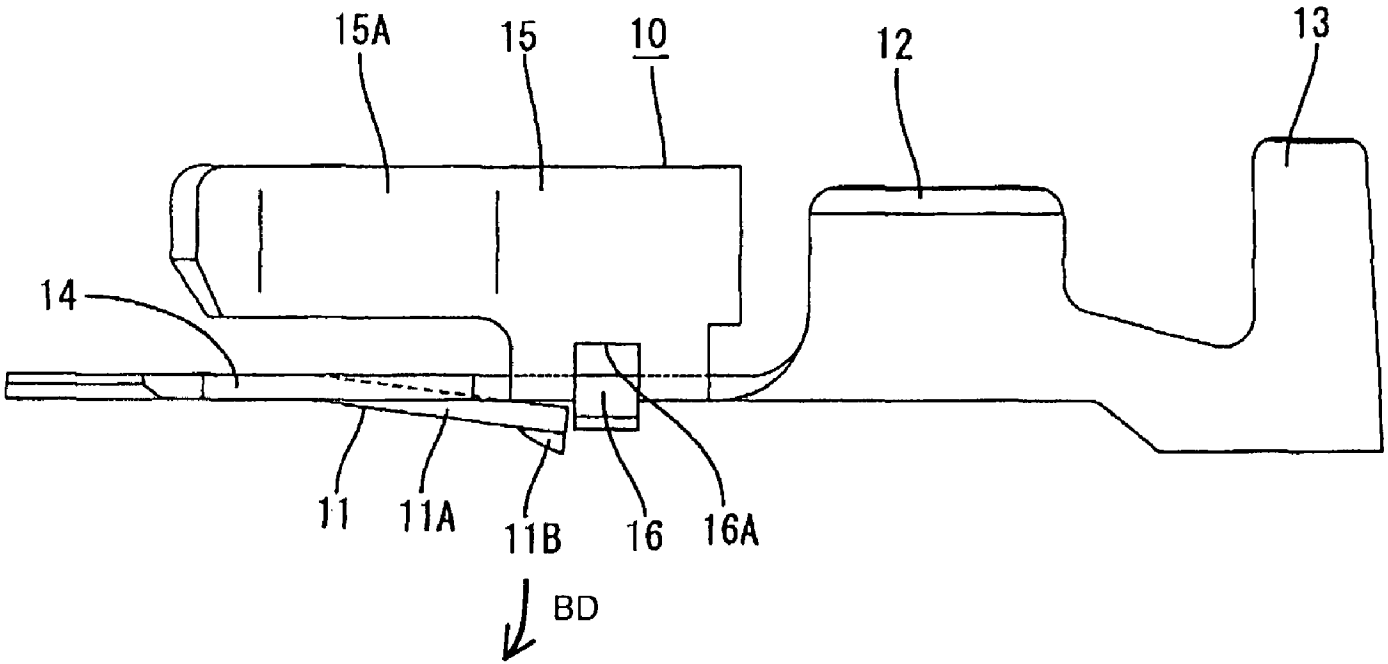
FIG. 2 is a side view of the terminal fitting.
Figure 3:
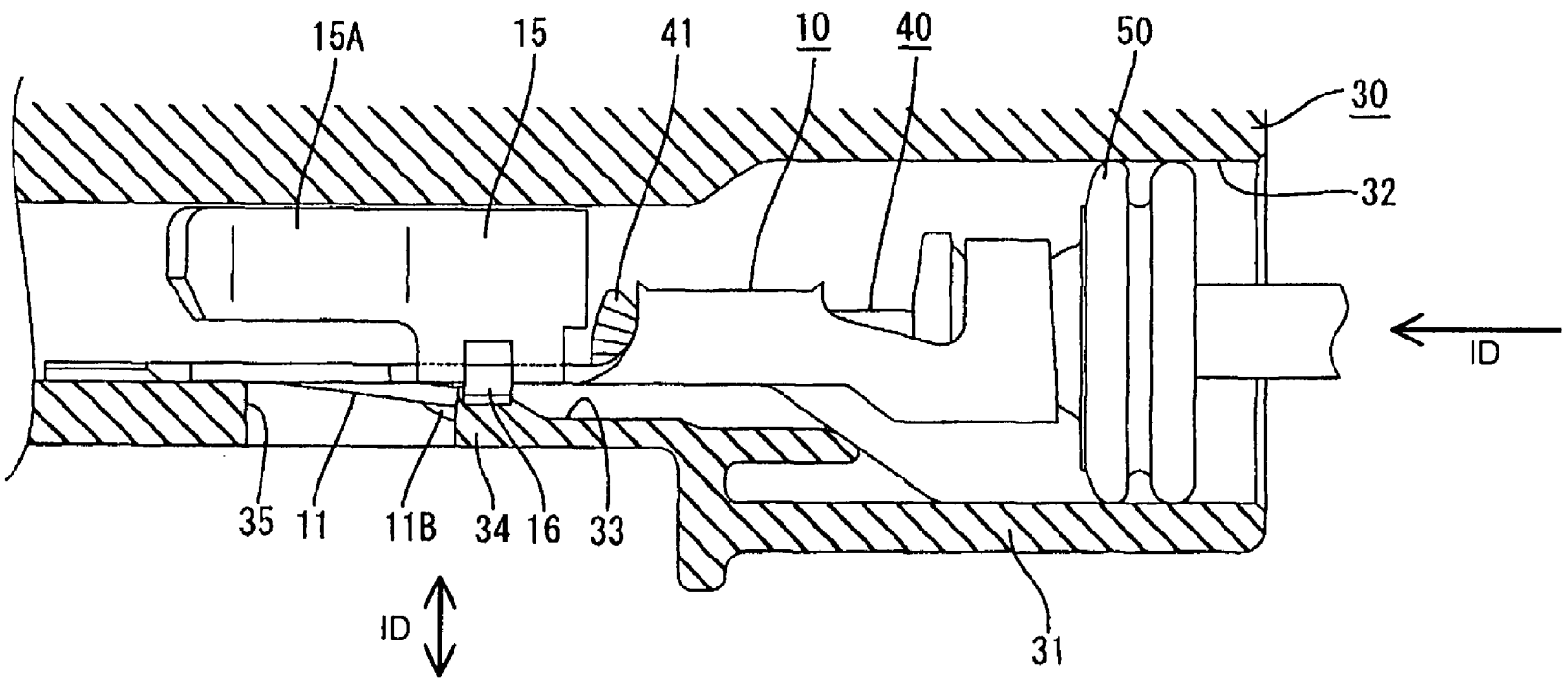
FIG. 3 is a side view showing a state where the terminal fitting is properly inserted in a cavity.

A female terminal fitting according to a first embodiment of the invention is identified by the numeral 10 in FIGS. 1 to 4. The terminal fitting 10 is mountable in a housing 30 that preferably is made of a synthetic resin and is adapted for connecting a bulb socket. As shown in FIG. 3, the housing 30 has a terminal mounting portion 31, and a cavity 32 is formed inside this terminal mounting portion 31 for receiving the terminal fitting 10. A lock insertion groove 33 is formed in the inner surface of the cavity 32 and extends substantially along forward and backward directions. An engaging portion 34 is formed at the front end of the insertion groove 33 and projects into the cavity 32. A locking hole 35 is formed before the engaging portion 34 and penetrates the bottom wall of the cavity 32.

The terminal fitting 10 is formed by folding, embossing and/or bending an electrically conductive metal plate stamped or cut out into a specified shape by a press. This terminal fitting 10 is long and narrow along forward and backward directions, and has a wire connection portion and a mounting portion one after the other at the rear of the terminal fitting 10. The wire connecting portion comprises wire barrels 12 for crimped, bent or folded connection with a core 41 of a wire 40, and the mounting portion comprises insulation barrels 13 for crimped, bent or folded connection with a rubber plug 50 mounted on the insulation coating of the wire 40, as shown in FIG. 3.

A substantially flat bottom plate 14 extends forward and back at the front of the terminal fitting 10, as shown in FIGS. 1 and 2. Left and right side walls 15 stand up at rear ends of the opposite sides of the bottom plate 14, and left and right resilient pieces 15A project substantially forward in an inserting direction ID of the terminal fitting 10 into the housing 30 from the respective side walls 15. The leading end of each resilient piece 15A is curved or bent in to form a moderate angle (e.g. less than about 60° with respect to the inserting direction ID) when viewed from above. A contact of an unillustrated bulb can be inserted between the resilient pieces 15A to be held resiliently therebetween for establishing electrical connection between the terminal fitting 10 and the bulb.

A resiliently deformable metal lock 11 is formed by cutting and bending an intermediate portion of the bottom plate 14. Specifically, the metal lock 11 is formed by making a long narrow substantially U-shaped cut 14A to extend forward and backward in the bottom plate 14 along the inserting direction ID and bending a plate piece formed inside the cut 14A out in a bending direction BD. Thus, the metal lock 11 has a fixed end and a free end that extends obliquely down and out to the back (see e.g. FIG. 2). Left and right lock protecting portions 16 are formed by cutting and bending at the substantially opposite lateral sides of the leading end of the metal lock 11 in the lower surface of the bottom plate 14. Specifically, the protecting portions 16 are formed by making cuts 16A extending over an edge from the bottom plate 14 to the side walls 15 and bending plate pieces formed inside the cuts 16A to extend obliquely down and out along the bending direction BD to substantially opposite sides. The protecting portions 16 prevent external matter, such as a wire, from entering between the metal lock 11 and the bottom plate 14.

Figure 4:
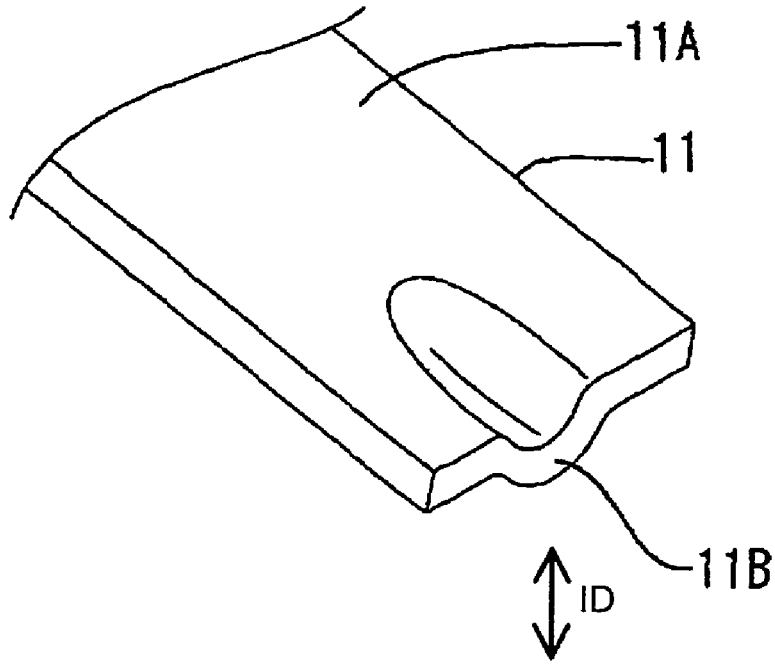
FIG. 4 is an enlarged perspective view showing an extended portion of the terminal fitting.

The metal lock 11 is comprised of a base 11A and an extended portion 11B, as shown in FIG. 4. The base 11A is a substantially flat plate having a substantially constant width from the front end to the rear end thereof. The extended portion 11B is formed by embossing an intermediate portion of the leading end of the base 11A to bulge down and out. Specifically, the extended portion 11B is embossed at the middle part of the leading end of the base 11A to bulge out in a thickness direction TD, which is substantially in the bending direction BD and substantially normal to the inserting direction ID. The extended portion 11B has a substantially rounded cross section, and is a recessed only at the leading longitudinal end of the base 11 (see e.g. FIG. 4).

The wire barrels 12 and the insulation barrels 13 are crimped into connection with the wire 40 and the resilient rubber plug 50, respectively. The terminal fitting 10 then is inserted into the cavity 32 of the housing 30 from behind and along the inserting direction ID. Thus, the metal lock 11 enters the lock insertion groove 33 of the cavity 32 and contacts the engaging portion 34. As a result, the metal lock 11 is deformed resiliently up in a direction opposed to the bending direction BD. The metal lock 11 is restored resiliently out in the bending direction BD when the terminal fitting 10 reaches a proper insertion position. As a result, the metal lock 11 enters the locking hole 35 and engages the engaging portion 34. In this way, the terminal fitting 10 is prevented from coming backward out of the housing 30. If the wire 40 secured to the terminal fitting 10 is pulled backward in this state, the leading end of the metal lock 11 engages or bites in a facing wall surface of the locking portion to be fixed there.

The extended portion 11B bulges in the thickness direction TD at the leading end of the metal lock 11. Thus, an area of engagement with the engaging portion 34 is increased by about as much as the extending portion 11B. As a result, the metal lock 11 bites in the engaging portion 34 more strongly. Further, the extended portion 11B increases the overall thickness of the metal lock 11 in the thickness direction TD. Thus, the space between the leading end of the metal lock 11 and the bottom plate portion 14 is shorter. As a result, external matter, such as a wire, cannot easily enter the clearance corresponding to this space, and the metal lock 11 is not damaged easily by such external matter.

Figure 5:
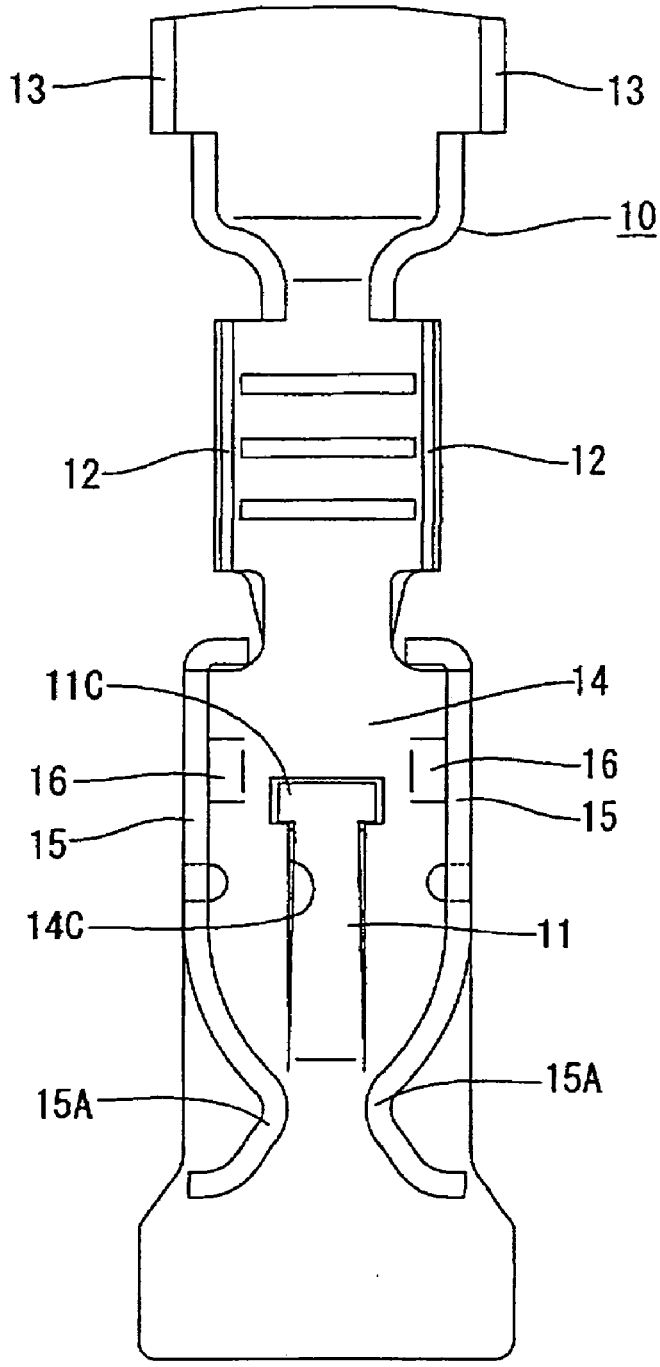
FIG. 5 is a plan view of a terminal fitting according to a second embodiment.
Figure 6:
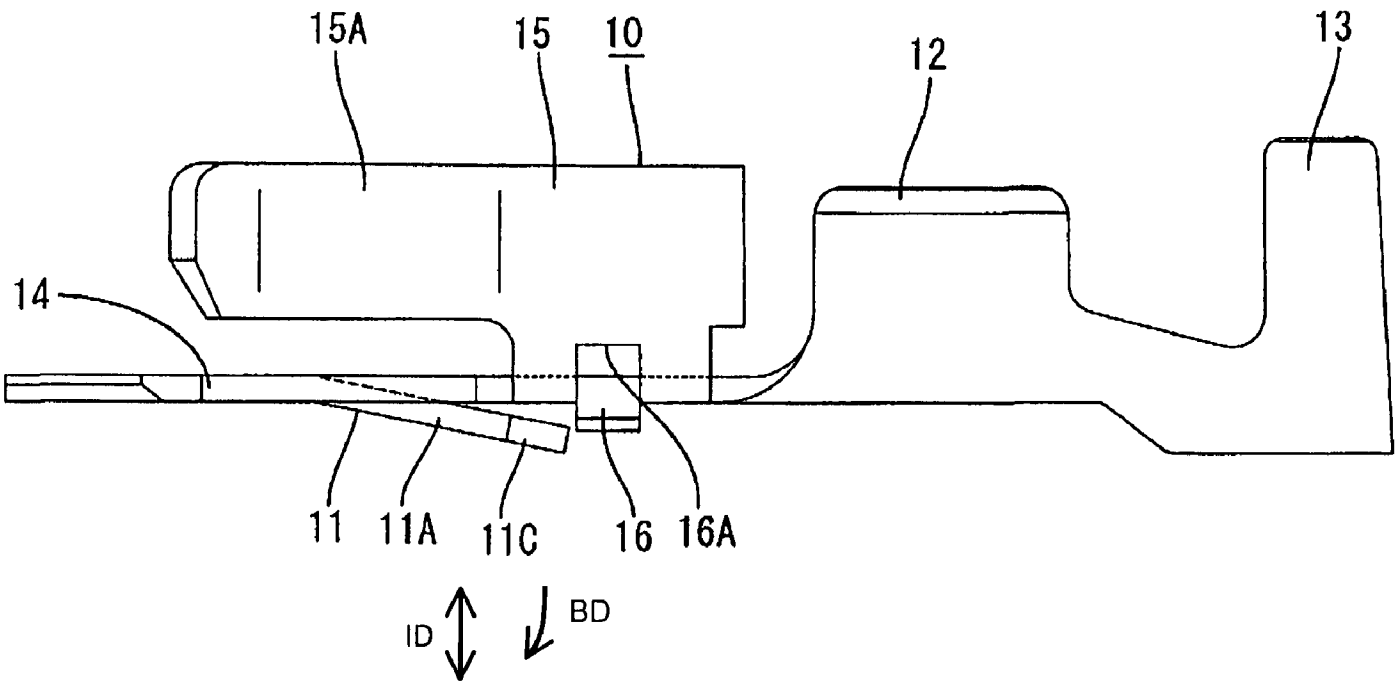
FIG. 6 is a side view of the terminal fitting of FIG. 5.
Figure 7:
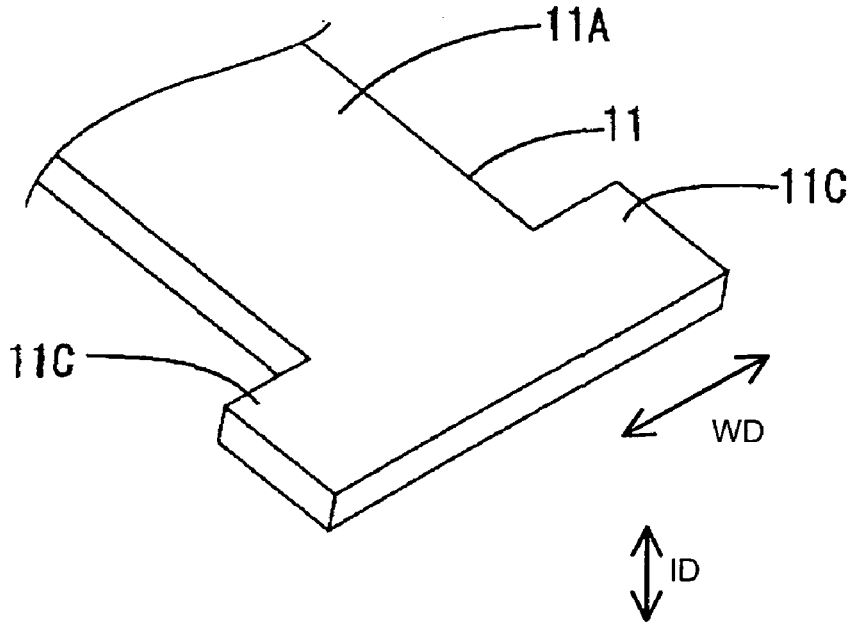
FIG. 7 is an enlarge perspective view showing extended portions of the terminal fitting of FIG. 5.

A second embodiment of the invention is described with reference to FIGS. 5 to 7. In the second embodiment, a metal lock 11 is formed with extended portions 11C bulging out along a widthwise directions WD, and hence a direction substantially normal to both the thickness direction TD and the bending direction BD. Specifically, as shown in FIG. 7, the metal lock 11 of the second embodiment has a base 11A in the form of a substantially flat plate that has a substantially constant width from the front end to the rear end thereof. Two extended portions 11C bulge out from the leading or distal end of the base 11A towards the opposite sides substantially along the widthwise direction WD. Thus, the metal lock 11 has a substantially T-shape. As shown in FIG. 5, a substantially T-shaped cut 14C is made in a bottom plate portion 14 and a plate piece formed inside the cut 14C is bent in the bending direction BD to extend obliquely down and out to the back.

The metal lock 11 of the second embodiment has the extended portions 11C, and hence exhibits an enhanced terminal holding force similar to the first preferred embodiment. Further, the extended portions 11C are formed when the metal lock 11 is cut or stamped and do not require a succeeding embossing step. Thus, production is even easier.

Figure 8:
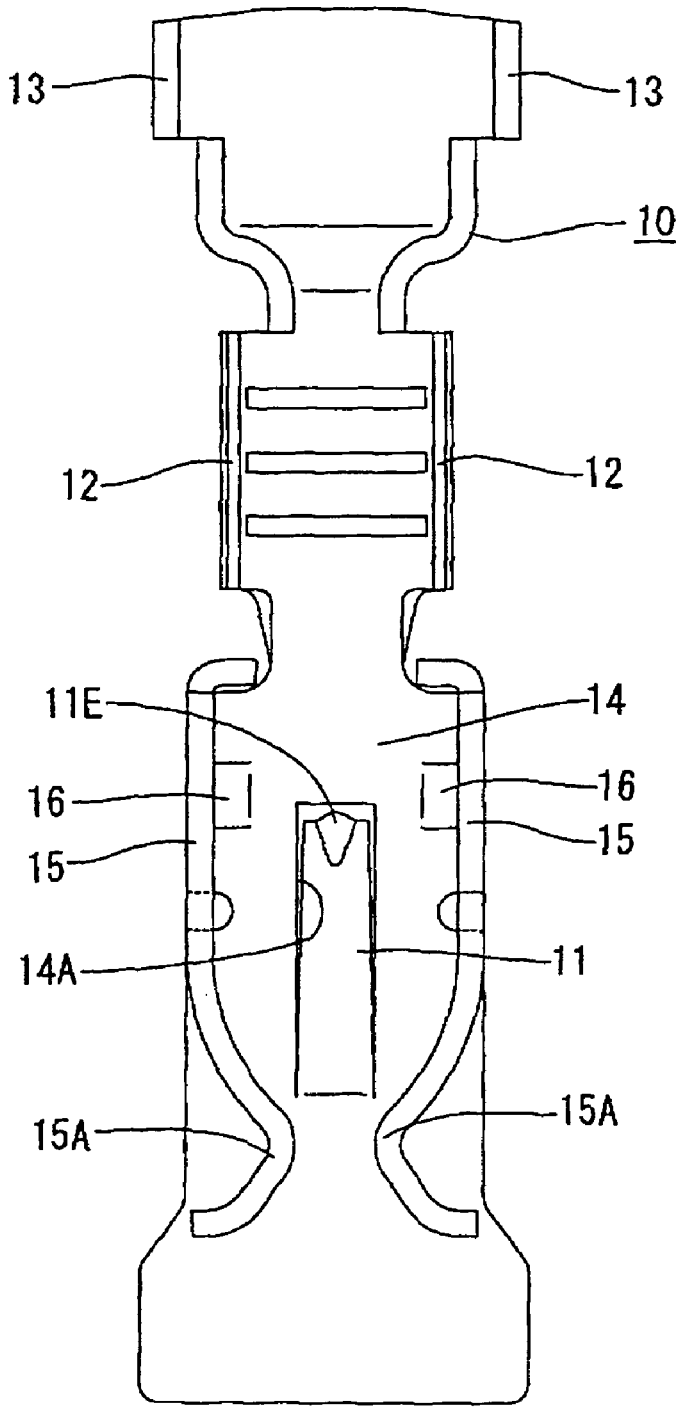
FIG. 8 is a plan view of a terminal fitting according to a third embodiment.
Figure 9:
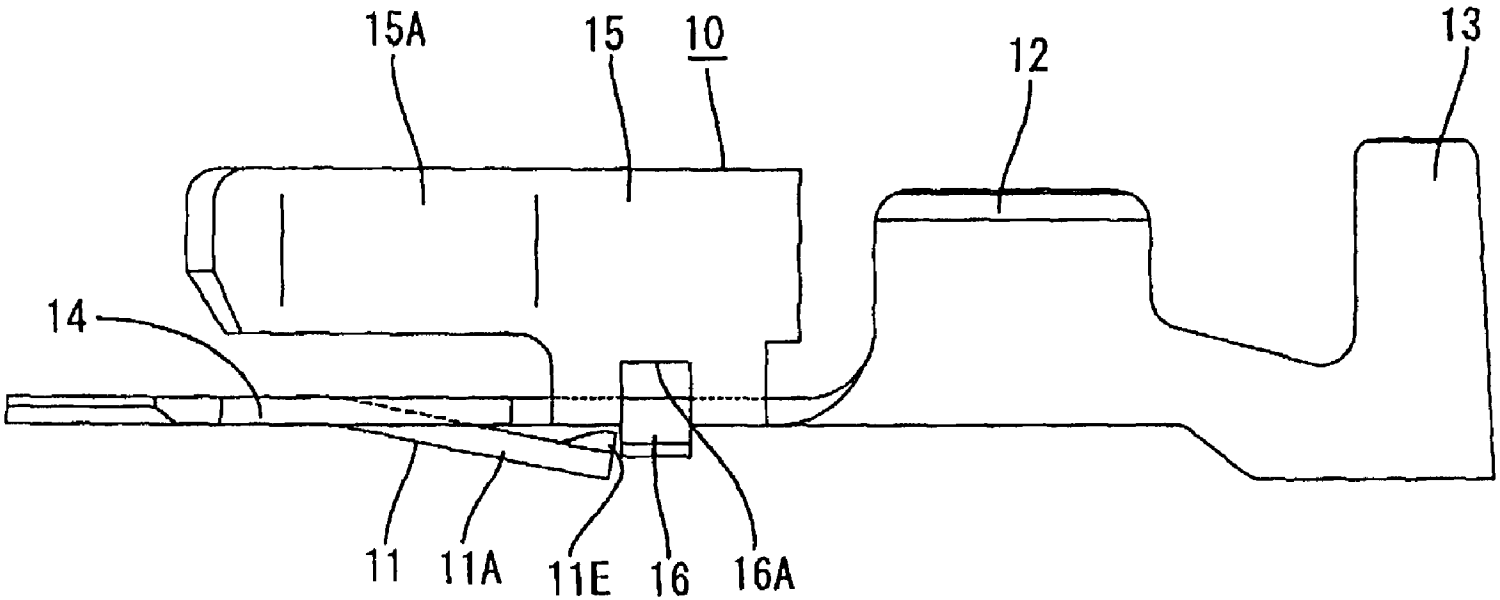
FIG. 9 is a side view of the terminal fitting of FIG. 8.
Figure 10:
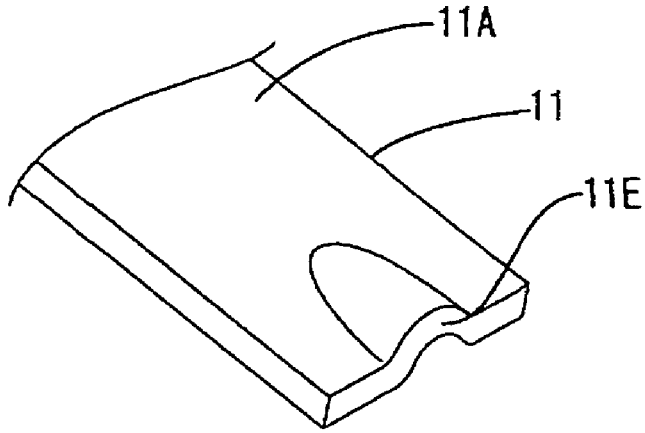
FIG. 10 is an enlarged perspective view showing an extended portion of the terminal fitting of FIG. 8.

FIGS. 8 to 10 show a third embodiment of the invention. A metal lock of the third embodiment has an extended portion 11E embossed an intermediate portion of the leading end of a base 11A to bulge out and up towards the terminal fitting 10 or the bottom plate 14 in a curved or bent manner to have an arc-shaped or bent cross section. The third embodiment is similar to the first embodiment except that the bulging direction of the extended portion 11E is substantially opposite from the first embodiment.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Terminal fittings used for bulb sockets are shown in the foregoing embodiments. However, the invention is also applicable to terminal fittings used for other purposes. For example, the invention is applicable to terminal fittings used by being mounted into housings of ordinary connectors.

The extended portions may bulge out in both the thickness and width directions WD and TD at the leading end of the base. For example, the extended portions may be a combination of the first and second embodiments.

The extended portion in the first or third embodiment may be formed over the entire length of the base instead of being formed only at the leading end.

The base 11A was described as a substantially flat plate having a substantially constant width from the front end to the rear end. However, the base 11A can be wider at the distal end than at a base end.

What is claimed is:

1. A terminal fitting formed to be mountable into a cavity of a housing, the housing being formed with an engaging portion adjacent the cavity, the terminal fitting including a plate and a resiliently deflectable lock that is engageable with the engaging portion in the housing to lock the terminal fitting so as not to come out of the cavity, wherein the lock comprises:

a substantially flat base projecting obliquely out from the plate, the base having a base end unitary with the plate and a leading end edge opposite the base end; and an extended portion at the leading end edge of the base and bulging out in at least one of a thickness direction and a widthwise direction, substantially all of leading end edge, including portions of the leading end edge on the extended portion, being disposed and configured for engaging the engaging portion, whereby the extended portion increases an area of engagement with the engaging portion when the terminal fitting is pulled in a withdrawing direction.

2. The terminal fitting of claim 1, wherein the lock is formed by cutting and bending.

3. The terminal fitting of claim 1, wherein the extended portion is formed by embossing a portion of the base.

4. The terminal fitting of claim 1, wherein at least one lateral lock protecting portion is formed in proximity to the leading end edge of the lock and projects out from the plate, the protecting portion being disposed so that portions of the plate extend between the protecting portion and the leading end of the lock.

5. The terminal fitting of claim 4, wherein the at least one protecting portion comprises two protecting portions formed by making cuts extending over an edge from the plate to adjacent side walls and bending plate pieces formed inside the cuts to extend out to substantially opposite sides.

6. A connector comprising:

a housing, at least one cavity the housing and an engaging portion formed in the housing adjacent the cavity; and a terminal fitting insertable into the cavity, the terminal fitting having a plate in the cavity, a lock protecting obliquely outward from the plate to a leading end edge, the lock having an extended portion at the leading end edge of the base and bulging out in at least one of a thickness direction and a width direction, substantially all of the leading end edge, including portions of the leading end edge on the extended portion, being disposed and configured for engaging the engaging portion, whereby the extended portion increases an area of engagement with the engaging portion when the terminal fitting is pulled towards the rear end of the housing.

7. The terminal fitting of claim 6, wherein the lock is formed by cutting and bending.

8. The terminal fitting of claim 6, wherein the extended portion is formed by embossing a portion of the base.

* * * * *